United States Patent [19]

Rankin

[11] Patent Number: 5,054,249

[45] Date of Patent: Oct. 8, 1991

[54] METHOD AND APPARATUS FOR LIQUID-ABRASIVE BLAST CLEANING

[76] Inventor: George J. Rankin, 13103 Barryknoll, Houston, Tex. 77056

[21] Appl. No.: 275,512

[22] Filed: Nov. 23, 1988

[51] Int. Cl.[5] ..... B24C 7/00

[52] U.S. Cl. ..... 51/436; 51/410; 51/439; 51/438

[58] Field of Search ..... 51/439, 427, 436, 320, 51/321, 410, 438

[56] References Cited

U.S. PATENT DOCUMENTS

| | | | |
|---|---|---|---|
| 1,230,654 | 6/1917 | Berry | 51/320 |
| 2,176,577 | 10/1939 | Tirrell | 51/321 |
| 2,518,047 | 8/1950 | Morel | 51/439 |
| 4,369,607 | 1/1983 | Bruggeman et al. | 51/427 |
| 4,569,160 | 2/1986 | Hengesbach | 51/436 |
| 4,817,342 | 4/1989 | Martin et al. | 51/439 |
| 4,829,724 | 5/1989 | Miller, Jr. | 51/436 |

FOREIGN PATENT DOCUMENTS

| | | | |
|---|---|---|---|
| 0722464 | 1/1955 | United Kingdom | 51/439 |
| 1538433 | 1/1979 | United Kingdom | 51/321 |
| 2191127 | 12/1987 | United Kingdom | 51/439 |

*Primary Examiner*—Robert A. Rose

*Attorney, Agent, or Firm*—Pravel, Gambrell, Hewitt, Kimball & Krieger

[57] ABSTRACT

A liquid-abrasive cleaning method and apparatus in which abrasive particles are accelerated into a high pressure liquid stream and transmitted by the liquid onto a surface for removing paint, rust or other substances coating the surface. The invention includes a flow regulator for regulating the flow of particles as they are drawn into the nozzle by the high pressure liquid stream.

9 Claims, 2 Drawing Sheets

METHOD AND APPARATUS FOR LIQUID-ABRASIVE BLAST CLEANING

BACKGROUND OF THE INVENTION

For many years efforts have been made to remove a variety of substances from various surfaces such as rust from metal and various contaminants from concrete and the like. Using high pressure water blasters with or without abrasive particles and high pressure air with sand or other particles to clean surfaces of rust and the like have long been known. These methods have been generally effective but in certain instances have been less than satisfactory. Sand blasting with air has been particularly difficult because of injury from inhaling the silicone particles and with high pressure air or high pressure water because of the need to recover and dispose of the sand which becomes contaminated with the material removed. Sodium chloride or common table salt has been found to be an effective abrasive when used with high pressure water, particularly because of its solubility in water. However, because of its hydroscopic nature, salt has a tendency to gain moisture and become clogged in the supply lines and/or the nozzle and not provide the steady stream desired for blast cleaning.

The present invention provides a method and apparatus for continuously accelerating the salt particles from the supply source to the high pressure nozzle and thus not becoming aglomerated into slugs which interrupt the blast cleaning operation. The nozzle of the present invention creates a vacuum effect in the supply line for drawing the salt particles from the supply and, by means of a flow regulator, the flow of particles is regulated so as to be accelerated from the supply source all the way to the nozzle chamber wherein the particles are mixed with the high pressure liquid. The flow regulator includes variable flow means to modulate the vacuum effect in the flow lines by aspirating air so as to provide a steady flow of accelerated particles through the supply line and with this variable control, it has been found that this desirable effect can be accomplished with flow lines of various lengths.

DESCRIPTION OF THE PREFERRED EMBODIMENT

Figure 1:
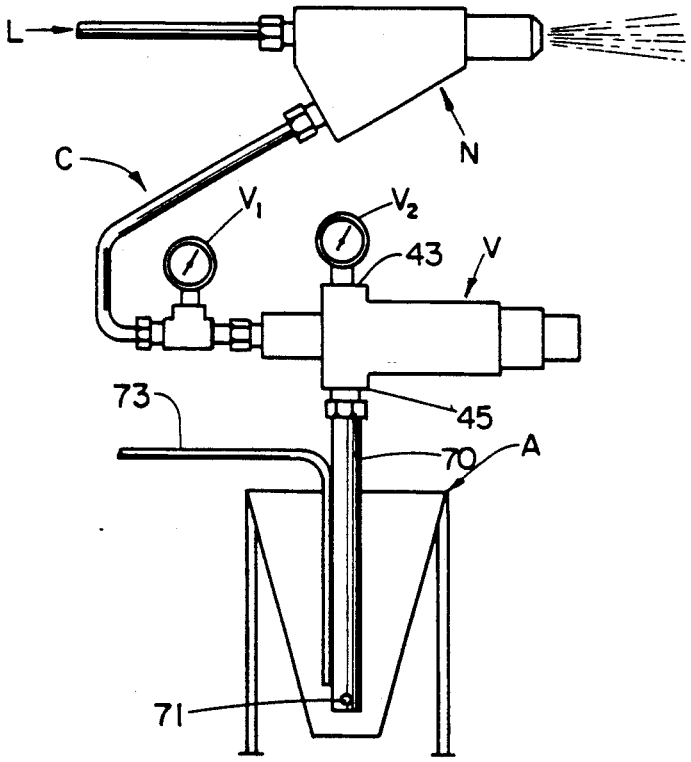
FIG. 1 is a schematic view showing the nozzle, a regulator and supply devices of the present invention.

As shown in FIG. 1 of the drawings, the apparatus of the present invention comprises a source of particulate abrasive A which is connected to a nozzle N by means of a conduit C having a flow regulator valve V for controlling the flow of particulate material to the nozzle N. A high pressure liquid supply line L is connected to the nozzle for supplying high pressure liquid for use in the cleaning operation at a pressure of from 500 psi to 5,000 psi and possibly higher for some applications. The particulate material and the high pressure liquid are mixed in the nozzle N and ejected through the discharge into the nozzle as will be explained in more detail hereinafter.

Figure 2:
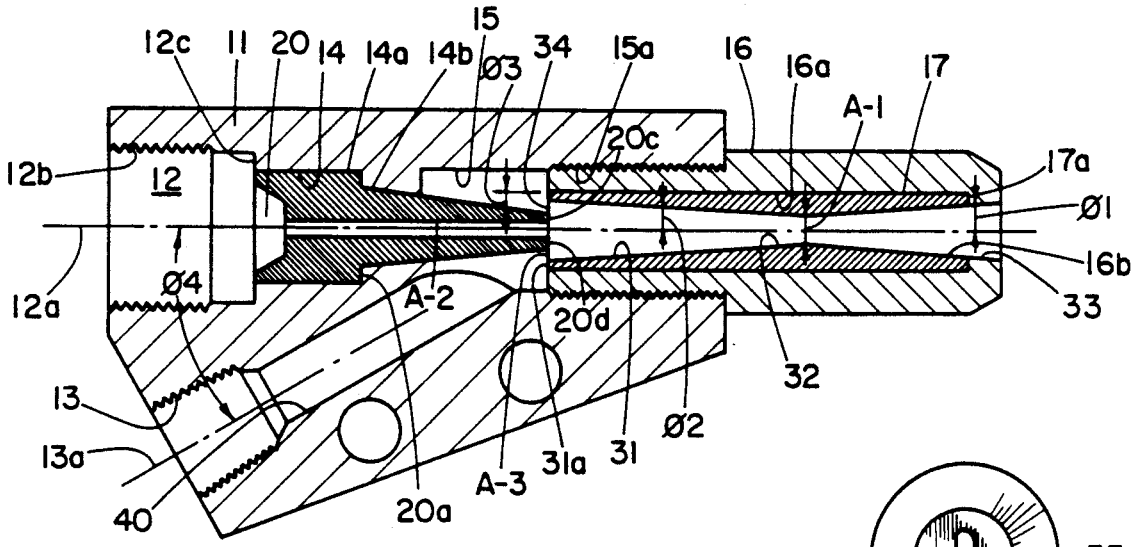
FIG. 2 is a longitudinal sectional view of the nozzle.

As shown in FIG. 2 of the drawings, a nozzle N comprises a housing 11 having a main bore 12 for connection to the high pressure liquid line and a second bore 13 for connection to the particulate conduit C. The secondary bore 13 has an axis 13*a* which is inclined with respect to the axis 12*a* of the primary bore 12 forming an angle $\phi 4$ of approximately 15°.

The bore 12 includes a threaded portion 12*b* which terminates at an annular shoulder 12*c*. Adjacent the shoulder 12*c* is a reduced diameter counterbore 14 that terminates at an annular shoulder 14*a* adjacent a tapered passage 14*b* that communicates with a second counterbore 15. The counterbore 15 has a threaded portion 15*a* for receiving the threaded end member 16 that carries the liquid-abrasive nozzle 17 which will be described in more detail hereinafter.

As shown, a high pressure water jet 20 is received in the counterbore 14 and is provided with an annular shoulder 20*a* that engages the annular shoulder 14*a*. As shown, the jet body has a tapered or conical exterior surface 20*b* extending from the shoulder 28 to the tip 20*c* and has a central passage or orifice 20*d* disposed centrally of axis 12*a*. The angle of the taper on the surface 20*b* is indicated as $\phi_3$ and is approximately 5°. The cross-section area of the orifice is indicated as $A_3$ in the drawings.

The converging-diverging nozzle insert 17 is provided in the distal end of the nozzle N. As shown, such nozzle has a generally cylindrical exterior adapted to be received in the bore 16*a* of the end member 16 with the end 17*a* abutting the annular shoulder 16*b* thereof. The interior of the nozzle 17 includes a tapered entrance passage 31, a reduced diameter throat passage 32 and a diverging exit passage 33. The angle of the tapered passage is indicated as $\phi 2$ and is approximately 7.75°. The throat cross-section is designated $A_1$ in the drawings. The entrance opening 31*a* is of a larger diameter than the external diameter of the tip 20*c* to provide an annular passage 34 extending around the tip 20*c* and providing communication with the nozzle 17. The cross-section area of the annular passage 34 is designated $A_3$ in the drawings.

Figure 2A:
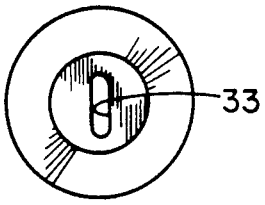
FIG. 2*a* is an end view of the discharge end of the nozzle shown in FIG. 2.

As shown in FIG. 2*a*, the tapered exit passage 33 is preferably flattened so as to provide a non-circular exit geometry to shape the pattern of the exit stream into a generally fan shaped configuration. Also, as shown in FIG. 2 of the drawing, the angle of divergence $\phi 1$ formed between the axis 12*a* and the tapered side of the exit nozzle is approximately 7½°.

The threaded port 13 communicates with passage 40 which is generally cylindrical and which intersects the chamber 15 adjacent the tapered neck of the jet nozzle 20*b* between the annular shoulder 20*a* and the tip 20*c*. Thus, it will be appreciated that particulate material passing through the conduit 40 will enter the chamber 15 surrounding the jet nozzle 20 and will be drawn into the converging passage 31 where the particulate matter will mix with the high pressure liquid and be discharged through the throat 32 and the diverging nozzle 33. It will also be appreciated that the stream of high pressure fluid passing through the venturi throat 32 will create a vacuum effect in the chamber 15, the passage 40 and the conduit C connected to the valve V.

Figure 3:
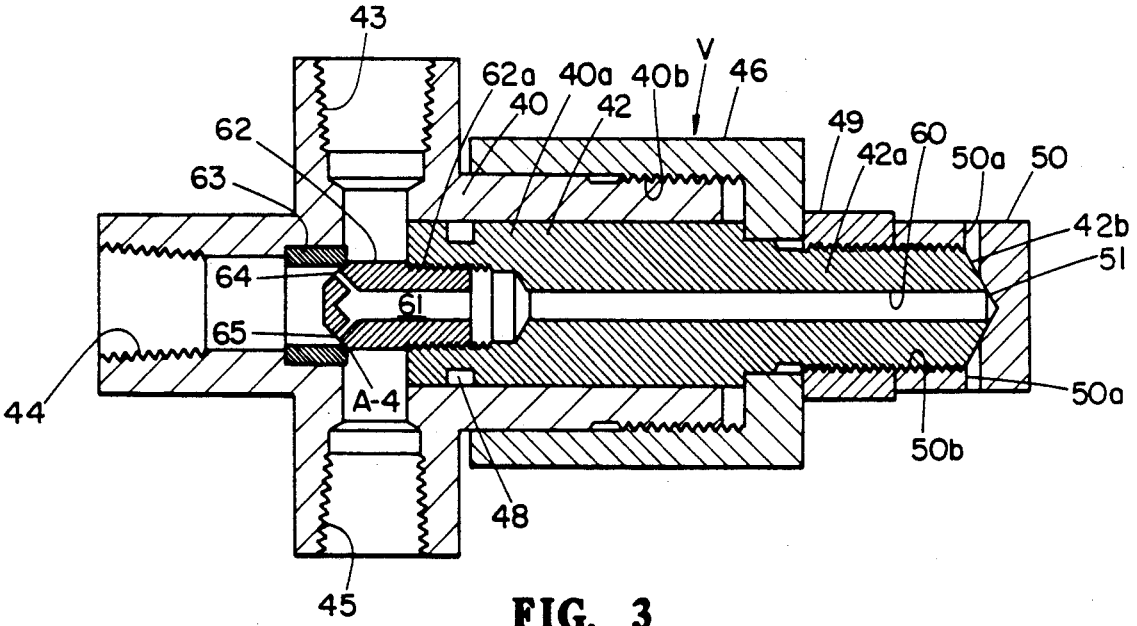
FIG. 3 is a longitudinal sectional view of the air regulator and manifold of the present invention.
Figure 4:
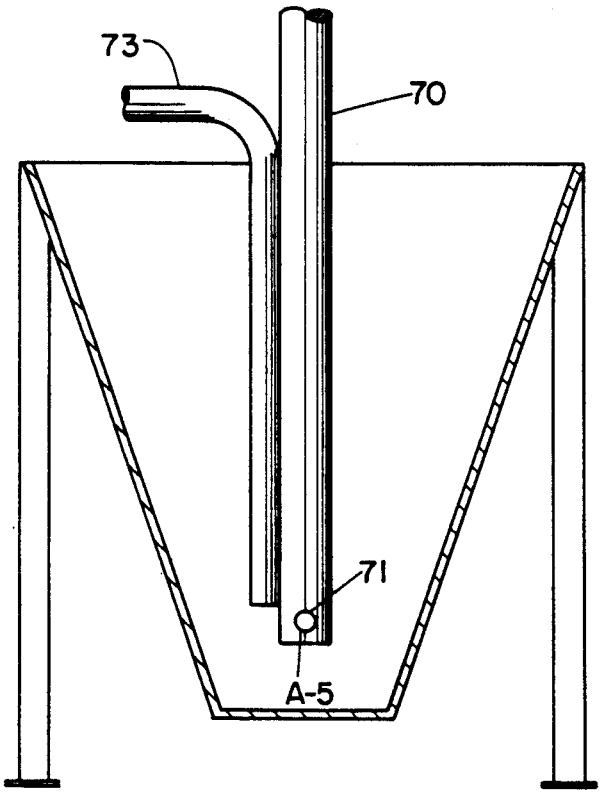
FIG. 4 is an enlarged view of the abrasives particle hopper and pick-up probe.

Referring next to the construction of the valve V as shown in FIG. 3 of the drawings, it will be noted that the valve V includes a valve manifold block 40 having a cylindrical chamber 40*a* for receiving a valve stem 42. The manifold block includes a valve port 43, a conduit port 44 and an abrasive particle port 45. The block 40 also includes an external threaded portion 40*b* which receives the threaded nut 46. The valve stem 42 includes a threaded end portion 42*a* which extends beyond the end of the valve block 40 for receiving a lock nut 49 and an air valve 50. The lock nut 49 is tightened so as to lock the value stem 42 and the nut 46 together so that rotation of the nut 46 will also turn the valve stem 42 for a purpose to be described hereinafter.

The air valve 50 is an air cap having a pair of laterally extending air passages 50*a* for allowing air to flow into the valve cap and a central chamber 51 having tapered sides for engaging the tapered end 42*b* on the valve body 40 when the air valve is tightened on its threads 50*b* to seat the tapered end of the valve stem and the air valve 50. Loosening the air valve 50 separates the tapered end 42*b* from the tapered chamber 51 to open flow through the passage 50*a* to the chamber 51.

As shown, the valve stem 42 also includes a central air passage 60 which communicates with the air inlet chamber 51 on one end and which communicates with a bore 61 in the valve insert 62 at its opposite end. The valve insert 62 is threaded tightly into the valve stem 42 at threads 62*a* and moves with the valve stem 42 to unseat the insert 62 from the valve seat 63 to open flow through the manifold passages 43, 44 and 45. The annular passage thus formed between the insert 62 and seat 63 is referred to as $A_4$ in the drawings. The valve insert 62 is provided with lateral passages 64 and 65 for providing communication or air flow through the hollow stem passage 60 when the valve 51 is opened. A groove 48 is provided in the valve stem for receiving an 0 ring or other suitable packing to seal between the valve stem and the inner surface 40*a* of the manifold housing 40.

As shown in FIG. 1, a vacuum gauge $V_1$ is provided in the conduit C and a second vacuum gauge $V_2$ provided for connection to the manifold outlet 43. Also, as shown an abrasive probe 70 is connected in the manifold outlet 45 for communicating with a supply of abrasive material contained in a hopper A. The lower end of the probe 70 is provided with an opening 71 through which the granular abrasive is drawn by the vacuum created in the nozzle and communicated through the conduit C to the probe 70. The cross-section area of such opening 71 is indicated as $A_5$ in the drawings. Also, as shown a gas inlet or air inlet tube 73 is provided which extends downwardly to a point near the opening 71 to allow air or gas to pass into the supply of granular abrasive in the hopper A to a point near or adjacent to the opening 71.

In operation, the air regulator or control is initially set with air inlet valve 50 closed and with the valve insert 62 closed so that no air flows through the conduit C. With high pressure liquid passing through the nozzle and the air regulator closed the vacuum gauge $V_1$ will read or indicate a vacuum pressure of approximately 29.8 inches of mercury. With the high pressure fluid passing through the nozzle, the nut 46 is rotated relative to the manifold housing 40 and the valve stem 42, carried by the nut 40 is moved laterally to unseat the insert valve 62 from its seat 63 and thus open flow through the manifold passages 43, 44 and 45. Next, the air inlet valve is opened to allow air to flow through the passages 50*a*, the passage 60, and inclined passages 64 and 65 to balance the flow of particulate matter and air through the regulator V. It will be noticed that when the valve 62 is initially opened before the air inlet valve 50 is opened, the gauges $V_1$ and $V_2$ flutter as the abrasive material drawn through the probe 70 tends to come in surges or slugs and does not have an apparently even or steady flow. Opening the air inlet valve 50 and allowing air to pass through the conduit 60 balances the flow of air and particulate abrasive and provides an even accelerated flow of such particles through the regulator V and also through the conduit C to the nozzle N. This type of balanced flow, is indicated when the vacuum gauges $V_1$ and $V_2$ both read about the same value, say approximately 12 to 15 inches of mercury and indicate steady pressure condition, i.e., the gauges no longer flutter. With this condition, the particles move smoothly and continuously into the nozzle in a steady flow of particles which are accelerated into the nozzle for mixing with the high pressure liquid. Thus, the metering valve of the regulator V provides an incremental acceleration of the abrasive from the pick-up in the probe 70 through the regulator and to the nozzle N and further, the regulator provides a means of balancing the flow through the conduit C to accommodate flow lines of different lengths so that the abrasive container A can be positioned at a convenient distance from the nozzle N.

Further, it will be appreciated that in the preferred embodiment of this invention the angle $\phi_3$ is greater than the angle $\phi_2$ by approximately 3° included angle. Also, angle $\phi_1$ and $\phi_2$ are optimally designed and sized so as to cause the abrasive mixture of high pressure water and particulate abrasive to exit the nozzle with maximum energy.

It will also be appreciated that in order to provide steady flow of abrasive particles from the supply hopper to through the flow regulator V and the conduit C to the converging chamber 31 in nozzle N, it is important to cause such abrasive particles to be continually accelerated throughout such passage. This is accomplished when the various parts are sized such that the cross-section areas respectively meet the condition that $A_3$ is smaller or less that $A_4$ is smaller or less than $A_5$. Also, with the condition such that $A_1$ is greater than or equal to the combined cross-section areas of $A_2$ plus $A_3$ and $A_7$ greater than $A_1$ homogeneous mixing of high pressure liquid and abrasive particles and air takes placed in the converging chamber 31 and the diverging chamber 33 transition gradually from converging chamber 31 so that the volume of mixed high pressure liquid, abrasive particles and air or gas exits the nozzle with maximum energy potential.

I claim:

1. A pressurized liquid-abrasive blast cleaner for combining abrasive particles into a high pressure liquid stream, comprising:

a source of abrasive particles;

a nozzle means including a high pressure liquid jet with an orifice through which the high pressure liquid passes;

conduit means connecting said abrasive particle source and said nozzle means;

converging-diverging wall nozzle means aligned axially with said orifice for receiving the high pressure liquid jet for drawing the abrasive particles into such liquid jet stream for ejection from such nozzle;

metering valve means in said conduit means between said source of abrasive particles and said nozzle means for regulating the flow of abrasive particles to the nozzle by mixing the particles in the conduit means with a variable amount of air to provide a steady flow of continuously accelerating particles to said nozzle means; and an abrasive particle pick-up probe having an opening therein for aspirating particles from a supply source with air supply means extending from outside the abrasive particle supply to a point adjacent or near the probe pick-up opening.

2. Said converging-diverging nozzle means including a conical converging wall chamber with its larger diameter and adjacent the discharge end of said water jet orifice and a tapered diverging wall camber for creating a vacuum-like pressure in the converging wall chamber and said conduit means is connected to an inclined passage in said nozzle for introducing abrasive particles adjacent said larger diameter end of said converging wall chamber for passage through a throat passage disposed between said converging and said diverging wall chambers for discharge from said diverging wall chamber;

measuring means communicating with said conduit means for indicating the relative vacuum pressure in said conduit;

measuring means for indicating the relative vacuum pressure in said metering valve and air inlet means for adjusting the flow of air through said metering valve for regulating the flow of particles through said metering valve and said conduit to said nozzle; and an abrasive particle pick-up probe having an opening therein for aspirating particles from a supply source with air supply means extending from outside the abrasive particle supply to a point adjacent or near the probe pick-up opening.

3. The invention of claim 2, wherein:

said water jet means and larger end of said converging wall chamber are arranged in juxtaposition to form an annular opening adjacent to the larger end of said converging wall chamber around the discharge end of said water jet means which annular opening has a smaller cross-section area than the area of said water jet orifice and wherein said water jet orifice has a smaller cross-section area than said particle inlet opening whereby particles aspirated through said particle inlet opening, said metering means and said conduit are accelerated from said particle supply source to said nozzle.

4. The invention of claim 3, wherein:

the cross-sectional area of said nozzle throat is greater than or equal to the combined areas of the annular opening in the larger end of said converging wall chamber around the discharge end of said water jet means and the cross-sectional area of said water jet orifice.

5. The invention of claim 3, wherein:

the particle inlet opening is larger than the cross-sectional area of said throat between the converging and diverging chambers in said nozzle.

6. A pressurized liquid-abrasive blast cleaner for combining abrasive particles into a high pressure liquid stream, comprising:

said nozzle means includes a water jet having an orifice therein for passing high pressure water through said jet;

a converging-diverging nozzle having a conical converging wall chamber with its larger diameter end adjacent the discharge end of said water jet orifice and a tapered diverging wall chamber for creating a vacuum-like pressure in the converging wall chamber and conduit means connected to an inclined passage in said nozzle for discharging abrasive particles adjacent said larger diameter end of said converging wall chamber for passage through a throat passage disposed between said converging and said diverging wall chambers for discharge from said diverging wall chamber; and metering means communicating with said conduit means for measuring the vacuum pressure in said conduit;

metering means for indicating the relative vacuum pressure in said metering valve and air inlet means for adjusting the flow of air through said metering valve for regulating the flow of particles through said metering valve and said conduit to said nozzle; and an abrasive particle pick-up probe having an opening therein for aspirating particles from a supply source with air supply means extending from outside the abrasive particle supply to a point adjacent or near the probe pick-up opening.

7. The invention of claim 6 wherein:

said water jet means and larger end of said converging wall chamber are arranged in juxtaposition to form an annular opening adjacent to the larger end of said converging wall chamber around the discharge end of said water jet means which annular opening has a smaller cross-section area than the area of said water jet orifice and wherein said water jet orifice has a smaller cross-section area than said particle inlet opening whereby particles aspirated through said particle inlet opening, said metering means and said conduit are accelerated from said particle supply source to said nozzle.

8. The invention of claim 7, wherein:

the cross-sectional area of said nozzle throat is greater than or equal to the combined areas of the annular opening in the larger end of said converging wall chamber around the discharge end of said water jet means and the cross-sectional area of said water jet orifice.

9. The invention of claim 7, wherein:

the particle inlet opening is larger than the cross-sectional area of said throat between the converging and diverging chambers in said nozzle.

* * * * *